US008789497B2

(12) United States Patent
Weinrotter et al.

(10) Patent No.: US 8,789,497 B2
(45) Date of Patent: Jul. 29, 2014

(54) LASER SPARK PLUG AND METHOD FOR OPERATING SAME

(75) Inventors: Martin Weinrotter, Vitoria-Gasteiz (ES); Martin Astner, Freiberg A.N. (DE); Pascal Woerner, Korntal-Muenchingen (DE); Juergen Raimann, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/511,324

(22) PCT Filed: Sep. 23, 2010

(86) PCT No.: PCT/EP2010/064053

§ 371 (c)(1),
(2), (4) Date: Oct. 4, 2012

(87) PCT Pub. No.: WO2011/060983

PCT Pub. Date: May 26, 2011

(65) Prior Publication Data

US 2013/0025549 A1 Jan. 31, 2013

(30) Foreign Application Priority Data

Nov. 23, 2009 (DE) ..... 10 2009 047 010

(51) Int. Cl.
*F01P 1/10* (2006.01)

(52) U.S. Cl.
USPC ..... 123/41.32; 123/143 B; 372/36

(58) Field of Classification Search
CPC ..... F02P 23/04; F01P 3/16; F01P 1/10
USPC ..... 123/41.32, 41.31, 143 B; 372/34, 35, 372/36; 431/1, 254, 258
See application file for complete search history.

(56) References Cited

U.S. PATENT DOCUMENTS

| | | | | |
|---|---|---|---|---|
| 4,434,753 | A * | 3/1984 | Mukainakano et al. | 123/143 B |
| 4,852,529 | A * | 8/1989 | Vowles | 123/143 B |
| 6,019,081 | A * | 2/2000 | Divecha et al. | 123/254 |
| 6,053,140 | A * | 4/2000 | Feichtinger et al. | 123/143 B |
| 6,514,069 | B1 * | 2/2003 | Early et al. | 431/1 |
| 7,114,858 | B2 * | 10/2006 | Gupta et al. | 385/88 |
| 7,499,477 | B2 * | 3/2009 | Winklhofer et al. | 372/10 |

(Continued)

FOREIGN PATENT DOCUMENTS

| | | |
|---|---|---|
| AT | 505 766 | 4/2009 |
| DE | 10 2009 000487 | 8/2010 |

(Continued)

*Primary Examiner* — Hung Q Nguyen
(74) *Attorney, Agent, or Firm* — Kenyon & Kenyon LLP

(57) ABSTRACT

A laser spark plug is described, in particular for an internal combustion engine of a motor vehicle, having a combustion chamber window situated in an end area facing the combustion chamber. Arrangement is provided for cooling a volume region present in the area of the combustion chamber window and/or a medium present in the volume region. The cooling arrangement has a cooling body which has material having a relatively great thermal conductivity, in particular having a thermal conductivity of approximately 90 Watts per Kelvin and meter at room temperature or more. The cooling body is designed essentially annularly. An inner diameter of the cooling body in the area of a front side facing the combustion chamber of the cooling body is smaller than an inner diameter of the cooling body in the area of a front side of the cooling body facing away from the combustion chamber.

14 Claims, 1 Drawing Sheet

(56) References Cited

U.S. PATENT DOCUMENTS

| | | | | |
|---|---|---|---|---|
| 7,770,552 | B2 * | 8/2010 | Schultz | 123/143 B |
| 7,806,094 | B2 * | 10/2010 | Gruber | 123/143 B |
| 2003/0136366 | A1 * | 7/2003 | Herdin et al. | 123/143 B |
| 2007/0064746 | A1 * | 3/2007 | Winklhofer et al. | 372/10 |
| 2009/0159031 | A1 * | 6/2009 | Gruber | 123/143 B |
| 2009/0159032 | A1 * | 6/2009 | Gruber | 123/143 B |
| 2010/0275867 | A1 * | 11/2010 | Weinrotter et al. | 123/143 B |

FOREIGN PATENT DOCUMENTS

| | | | | |
|---|---|---|---|---|
| JP | 55-88074 | | 12/1953 | |
| JP | 2005240782 | A * | 9/2005 | F02P 23/04 |
| WO | 2009/043608 | | 4/2009 | |

* cited by examiner

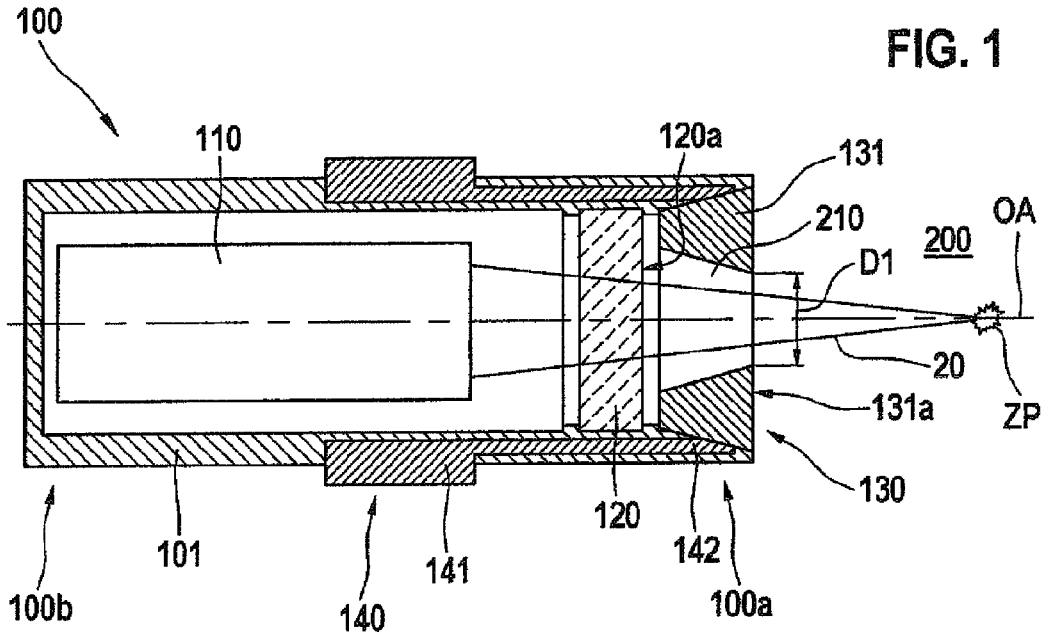
FIG. 1
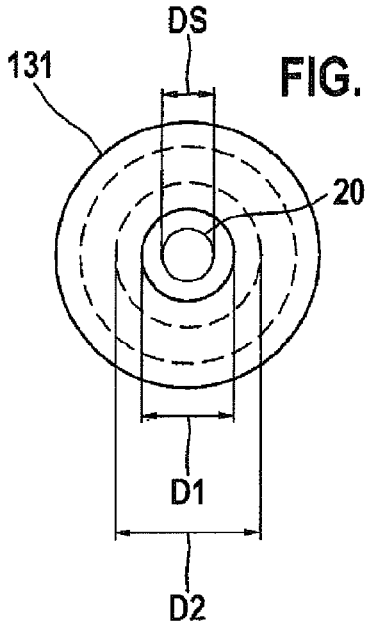
FIG. 2A
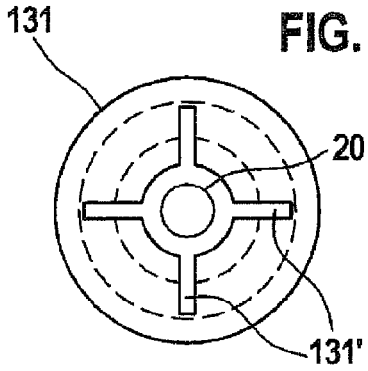
FIG. 2B
FIG. 3
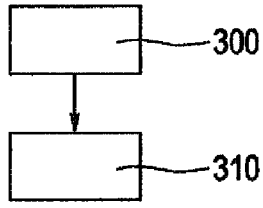

LASER SPARK PLUG AND METHOD FOR OPERATING SAME

FIELD OF THE INVENTION

The present invention relates to a laser spark plug, in particular for an internal combustion engine of a motor vehicle, having a combustion chamber window situated in an end area facing the combustion chamber. The present invention further relates to a method for operating a laser spark plug of this type.

BACKGROUND INFORMATION

During the operation of such a laser spark plug, deposits are formed on a surface of the combustion chamber window facing the combustion chamber through which laser radiation is irradiated into a combustion chamber associated with the laser spark plug. The deposits, which contain combustion products, have an adverse effect on a reliable operation of the laser spark plug and reduce its lifetime, in particular.

SUMMARY OF THE INVENTION

It is thus an object of the exemplary embodiments and/or exemplary methods of the present invention to improve a laser spark plug and an operating method of the type mentioned at the outset in such a way that an increased reliability and lifetime are achieved.

This object may be achieved according to the exemplary embodiments and/or exemplary methods of the present invention with the aid of a laser spark plug of the type mentioned at the outset in that an arrangement for cooling of a volume region present in the area of the combustion chamber window and/or of a medium present in the volume region are provided.

It has been recognized according to the exemplary embodiments and/or exemplary methods of the present invention that the deposition of some combustion products, in particular carbon and carbon compounds, which are produced during an operation of the laser spark plug on the surface of the combustion chamber window facing the combustion chamber, facilitates a successful cleaning of this surface, known per se, when laser radiation of high power density or energy density is applied to this surface.

According to the exemplary embodiments and/or exemplary methods of the present invention, it has furthermore been recognized that the cooling of the volume region surrounding the particular surface of the combustion chamber window or a medium present in the volume region facilitates the formation and the deposition of the combustion products, which are advantageous for ablative cleaning, on the surface of the combustion chamber window.

The cooling arrangement according to the present invention thus advantageously enable the targeted generation and introduction of those combustion products onto the surface of the combustion chamber window, which facilitate efficient cleaning by applying laser impulses of high power density or energy density to the combustion chamber window.

According to one particular advantageous specific embodiment of the laser spark plug according to the present invention, the cooling arrangement has a cooling body which has material having a relatively great thermal conductivity, in particular having a thermal conductivity of approximately 90 Watts per Kelvin and meter at room temperature or more. The cooling body may contain nickel or a nickel alloy. The entire cooling body may be produced completely from nickel or a nickel alloy.

The cooling body may be non-detachably connected to the housing of the laser spark plug, for example by welding.

A particularly efficient and uniform cooling of the volume region of interest results according to the exemplary embodiments and/or exemplary methods of the present invention when the cooling arrangement, in particular the at least one cooling body, surround, in particular concentrically surround, an optical axis of the laser spark plug.

In another very advantageous specific embodiment of the laser spark plug according to the present invention, in addition to the cooling intended according to the present invention, an efficient shielding of the surface of the combustion chamber window facing the combustion chamber against damaging particles results when the cooling body is designed essentially annularly, and an inner diameter of the cooling body in the area of a front side of the cooling body facing the combustion chamber accounts for maximally approximately 105 percent to approximately 200 percent of a beam diameter of the laser radiation emitted by the laser spark plug.

According to another variant of the exemplary embodiments and/or exemplary methods of the present invention, it is furthermore advantageous that an inner diameter of the cooling body in the area of a front side of the cooling body facing the combustion chamber is smaller than an inner diameter of the cooling body in the area of a front side of the cooling body facing away from the combustion chamber. In this way, a maximally possible cooling effect may be advantageously achieved, without simultaneously adversely affecting the laser radiation passing through the cooling body, since the volume region surrounded by the cooling body according to the present invention is ideally form-fitted to the focused laser radiation emitted by the laser spark plug.

In another very advantageous variant of the exemplary embodiments and/or exemplary methods of the present invention, it the heat-conducting arrangement may be provided which enable heat dissipation from an end area of the laser spark plug facing the combustion chamber in the direction of an end area facing away from the combustion chamber; the heat-conducting arrangement may be situated in an inner chamber of the laser spark plug and/or are integrated into at least one wall section of a housing of the laser spark plug.

Particularly advantageously, the cooling arrangement according to the exemplary embodiments and/or exemplary methods of the present invention may be in good thermal contact with the heat conducting arrangement so that efficient heat dissipation is possible from the area of the surface of the combustion chamber window facing the combustion chamber into the area of the laser spark plug facing away from the combustion chamber.

The heat-conducting arrangement may, for example, have contact areas in another area of the laser spark plug facing away from the combustion chamber, which establish good thermal contact with the cylinder head when the laser spark plug is installed into a cylinder head of an internal combustion engine, for example a stationary heavy-duty gas engine.

The cooling arrangement according to the exemplary embodiments and/or exemplary methods of the present invention may also have, in addition to one or multiple cooling bodies, a fluid-based cooling system, among other things, which removes thermal energy from the surface of the combustion chamber window facing the combustion chamber using a fluid.

Alternatively or additionally to the cooling body or cooling bodies, heat pipes or other heat-conducting arrangement may be used to cool down the volume region of interest. Heat pipes may also be advantageously integrated directly into a housing of the laser spark plug.

The object of the exemplary embodiments and/or exemplary methods of the present invention may also be achieved by a method according to the description herein. The method according to the present invention provides that a volume region present in the area of the combustion chamber window and/or a medium present in the volume region is cooled, which may be to a temperature of approximately below 350° C. to approximately below 300° C.

Studies by the applicant show that such an operation of the laser spark plug according to the present invention results in a particularly advantageous formation of such combustion products and their application to the surface of the combustion chamber window facing the combustion chamber; these combustion products promote cleaning of the combustion chamber window when applied with laser radiation of high power density or energy density.

It is believed according to the present invention that in particular carbon deposits facilitate cleaning. The cooling according to the present invention of the end area of the laser spark plug facing the combustion chamber, in particular of the volume region surrounding the combustion chamber window, makes it advantageously possible to introduce semicombusted and uncombusted hydrocarbons (for example, in the form of soot) into this area so that optimal support for the cleaning of the combustion chamber window with the aid of laser radiation is possible.

According to studies by the applicant, carbon deposits on the surface of the combustion chamber window facilitated by the present invention result in easier removal of other inorganic combustion residues which are deposited on the surface of the combustion chamber window facing the combustion chamber during the operation of the laser spark plug.

By introducing carbon compounds according to the exemplary embodiments and/or exemplary methods of the present invention, for example, calcium sulfate ($CaSO_4$) deposits may be cleaned by way of cooling the end area of the laser spark plug using laser radiation; the beam density of the laser radiation may be lower by up to one order of magnitude as compared to conventional cleaning procedures in which no carbon compounds or soot, which are introduced according to the present invention, are present on the surface of the combustion chamber window facing the combustion chamber.

Additional advantages, features and details are derived from the following description, in which different exemplary embodiments of the present invention are illustrated with reference to the drawing. The features mentioned in the claims and in the description may each be essential for the present invention either individually or in any combination.

BRIEF DESCRIPTIONS OF THE DRAWINGS

FIG. 1 shows a partial cross section of a laser spark plug according to the present invention.

FIG. 2*a* shows a specific embodiment of a cooling body for use with the cooling arrangement according to the present invention.

FIG. 2*b* shows another specific embodiment of a cooling body for use with the cooling arrangement according to the present invention.

FIG. 3 shows a simplified flow chart of a specific embodiment of the method according to the present invention.

DETAILED DESCRIPTION

FIG. 1 shows a first specific embodiment of laser spark plug 100 according to the present invention in a partial cross section. Laser spark plug 100 is, for example, used in internal combustion engines of motor vehicles or also in stationary heavy-duty gas engines for the purpose of irradiating laser radiation 20 in a focused manner onto an ignition point ZP situated in a combustion chamber of the internal combustion engine to ignite an air/fuel mixture present in combustion chamber 200.

For this purpose, laser radiation 20 may be generated locally in laser spark plug 100 in a manner known per se, by using a laser device 110, for example, which has a laser-active solid (not shown) and a passive Q-switch, among other things.

Alternatively thereto, the laser radiation, supplied to laser spark plug 100 by a remotely situated laser source, may be focused by laser spark plug 100 and irradiated onto ignition point ZP.

During the operation of laser spark plug 100, various combustion products, in particular inorganic components derived from, among other things, additives of the motor oil of the internal combustion engine, are deposited onto surface 120*a*, facing combustion chamber 200, of combustion chamber window 120 of laser spark plug 100.

It is already known to apply laser impulses of high power density or energy density to combustion chamber window 120 to clean inorganic deposits of this type from combustion chamber window 120.

It is believed according to the exemplary embodiments and/or exemplary methods of the present invention that the presence of carbon or carbon compounds on surface 120*a* of combustion chamber window 120 facilitates cleaning. According to studies by the applicant, in the presence of carbon, beam densities of laser radiation 20 which are lower by up to approximately one order of magnitude are necessary to clean the previously described deposits.

In contrast to that, conventional cleaning procedures require beam densities which lie in the order of magnitude of the material destruction threshold of combustion chamber window 120.

According to the exemplary embodiments and/or exemplary methods of the present invention, it has furthermore been recognized that, during the operation of laser spark plug 100, a temperature reduction of volume region 210, which lies in the area of combustion chamber window 120, or a fluid present therein facilitates carbon or carbon compound deposition in the area of surface 120*a* of combustion chamber window 120. Therefore, the carbon compounds necessary for an efficient cleaning may be particularly advantageously obtained from the combustion products produced during the laser ignition.

Laser spark plug 100 according to the present invention thus has an arrangement 130 for cooling volume region 210 present in an end area 100*a* facing the combustion chamber and/or a medium, such as combustion emissions, present in volume region 210.

In one particular specific embodiment, cooling arrangement 130 has at least one cooling body 131, which is designed here approximately annularly as is apparent from FIG. 1 and may be non-detachably connected to housing 101 of laser spark plug 100 at its end area 100*a* facing the combustion chamber.

Cooling body 131 may have material which has a relatively great thermal conductivity, in particular a thermal conductivity of approximately 90 Watts per Kelvin and meter at room temperature or more; for example, nickel or a nickel alloy may be used here.

A particularly uniform cooling of the medium present in end area 100*a* or volume region 210 is advantageously provided according to the present invention in that cooling body 131 surrounds, in particular concentrically surrounds, an optical axis OA of laser spark plug 100.

In addition to the previously described advantageous cooling effect, cooling body 131 according to the present invention is used in another variant of the present invention for simultaneously shielding surface 120*a* of combustion chamber window 120 against combustion particles, which are produced in the area of ignition point ZP and might damage combustion chamber window 120 when striking surface 120*a*. For this purpose, cooling body 131 is designed essentially annularly and an inner diameter D1 of cooling body 131 in the area of its front side 131*a* facing the combustion chamber is maximally approximately 105 percent to approximately 200 percent of a beam diameter DS (FIG. 2*a*) of laser radiation 20 emitted by laser spark plug 100.

For an efficient dissipation of the thermal energy, which is input into cooling body 131, heat-conducting arrangement 140 may be provided in housing 101 of laser spark plug 100 which enable a heat dissipation from end area 100*a* facing the combustion chamber of laser spark plug 100 in the direction of an end area 100*b* facing away from the combustion chamber. Heat-conducting arrangement 140 may have nickel and/or copper and or silver inserts 142 or inserts made of their respective alloys which are situated either directly in the inner chamber of laser spark plug 100 or else are integrated directly into at least one wall section of housing 101 of laser spark plug 100.

Heat-conducting arrangement 140 may also have a fluid-based system, in particular may also have one or multiple heat pipes or the like.

Cooling body 131 may be non-detachably, in particular integrally, connected to housing 101 of laser spark plug 100 in such a way that it is in good thermal contact with heat-conducting arrangement 140 or inserts 142.

Heat-conducting arrangement 140 has contact area 141 which establishes good thermal contact with a cylinder head (not shown) of an internal combustion engine if laser spark plug 100 is installed into the cylinder head in such a way that an efficient heat dissipation, which is input into laser spark plug 100, in particular into cooling body 131, is possible.

FIG. 2*a* shows a top view of front side 131*a* facing the combustion chamber (FIG. 1) of cooling body 131. It is apparent from FIG. 2*a* that inner diameter D1 of cooling body 131 in the area of front side 131*a* (FIG. 1) is only insignificantly greater than beam diameter DS of laser radiation 20, so that an effective protection of surface 120*a* of combustion chamber window 120 is achieved against particles, which may emanate from ignition point ZP or other areas of combustion chamber 200. According to one specific embodiment, inner diameter D1 is maximally approximately 105 percent to approximately 200 percent of beam diameter DS.

It may particularly be the case that inner diameter D1 of cooling body 131 in the area of front side 131*a* facing the combustion chamber (FIG. 1) is smaller than an inner diameter D2 of cooling body 131 in the area of the front side of cooling body 131 facing away from the combustion chamber, so that efficient cooling of volume region 210 and an advantageous form-fitting of the inside of cooling body 131 to laser radiation 20 emitted by laser spark plug 100 are achieved.

FIG. 2*b* shows a top view of another variant of a cooling body 131 according to the present invention in which a total of four radially extending recess grooves 131' are provided which enable improved fluid communication between combustion chamber 200 (FIG. 1) and volume region 210 surrounded by cooling body 131, making an efficient flushing of volume region 210 with fresh gas possible. The formation of a residual gas blanket may thus be advantageously prevented in the area of surface 120*a* of combustion chamber window 120, which helps to prevent surface 120*a* of combustion chamber window 120 from sooting due to premature quenching of the flame.

Alternatively to recess grooves 131', one or multiple bore holes (not shown) may also be provided in cooling body 131 to enable an improved exchange of fluid between combustion chamber 200 and volume region 210.

FIG. 3 shows a flow chart of a specific embodiment of the method according to the present invention.

In a first step 300, volume region 210 or a medium present therein is cooled, which may be to a temperature of approximately below 350° C. to approximately below 300° C. This results in advantageous deposition of carbon or carbon compounds in the area of surface 120*a* of combustion chamber window 120.

These carbon deposits enable an easier cleaning of combustion chamber window 120, the cleaning being accomplished in a subsequent step 310 in that laser radiation 20 of high power density or energy density is applied to surface 120*a* of combustion chamber window 120.

The laser beam density required for cleaning generally depends on the deposit material. Inorganic deposits, in particular, which are derived from additives of motor oil and the like, among other things, may only be cleaned with the aid of very high beam densities which are close to the material destruction threshold of combustion chamber window 120. The introduction of carbon into the parasitic deposits of combustion chamber window 120 made possible by the present invention advantageously allows the beam density necessary for the cleaning to be reduced. In particular, deposits containing $CaSO_4$ are conditioned by adding carbon compounds according to the present invention in such a way that only a beam density, which is lower up to approximately one order of magnitude, is advantageously necessary for the laser radiation used for cleaning.

In general, by using the exemplary embodiments and/or exemplary methods of the present invention, the construction of end area 100*a* facing the combustion chamber of laser spark plug 100 may be optimized in such a way that an efficient cooling of volume region 210 is possible to generate semicombusted and uncombusted hydrocarbon compounds in the area of combustion chamber window 120. The carbon quantities resulting therefrom in the deposit of inorganic combustion residue forming on surface 120*a* advantageously enable efficient cleaning with the aid of laser radiation 20 without simultaneously destroying combustion chamber window 120.

In particular in a temperature range of approximately 300° C. to approximately 350° C., a particularly efficient deposition of carbon or carbon compounds on combustion chamber window surface 120*a* is possible.

Cooling arrangement 130 according to the present invention allow for an efficient temperature reduction in volume region 210 upstream from combustion chamber window 120 so that a controlled quenching of the flames upstream from combustion chamber window 120 is achieved at the laser ignition. Moreover, it is important to deliver a sufficient amount of fresh mixture to combustion chamber window 120 so that no residual gas blanket forms upstream from combustion chamber window 120 which prevents sooting of window 120 due to premature quenching of the flame.

The residual gas blanket may be prevented from forming with the aid of recess grooves 131' (FIG. 2*b*), which are provided according to the present invention, in cooling body 131 and/or with the aid of additional bore holes in cooling body 131.

At the same time, it has to be taken into consideration that a too strong incident flow onto combustion chamber window 120 by the fluid originating from combustion chamber 200 must be avoided so that no particles from the combustion process are deposited on combustion chamber window 120. This is made possible by the geometry of cooling body 131 shown as an example in FIG. 1.

In what may be a particularly simple manner, a temperature reduction may be in the area of combustion chamber window 120 due to the retracted installation position of combustion chamber window 120 within laser spark plug 100 with regard to front surface 131*a* (FIG. 1) of cooling body 131.

Laser spark plug 100 according to the present invention may be used in internal combustion engines of motor vehicles and stationary (heavy-duty) gas engines or also (gas) turbines.

What is claimed is:

1. A laser spark plug for an internal combustion engine of a motor vehicle, comprising:

a combustion chamber window situated in an end area facing a combustion chamber; and an arrangement for cooling at least one of a volume region present in an area of the combustion chamber window and a medium present in the volume region, wherein the arrangement for cooling is adapted to cool the one of the volume region and the medium to a temperature of between 300° C. and 350° C.

2. The laser spark plug of claim 1, wherein the cooling arrangement includes a cooling body which has a material having a thermal conductivity of approximately at least 90 Watts per Kelvin and meter at room temperature.

3. The laser spark plug of claim 2, wherein the cooling body contains nickel or a nickel alloy.

4. The laser spark plug of claim 2, wherein the cooling body is configured essentially annularly and an inner diameter of the cooling body in an area of its front side facing the combustion chamber is maximally approximately 105 percent to approximately 200 percent of a beam diameter of laser radiation emitted by the laser spark plug.

5. The laser spark plug of claim 2, wherein an inner diameter of the cooling body in the area of a front side facing the combustion chamber is smaller than an inner diameter of the cooling body in the area of a front side of the cooling body facing away from the combustion chamber.

6. The laser spark plug of claim 2, wherein the cooling body is essentially completely made of nickel or a nickel alloy.

7. The laser spark plug of claim 1, wherein the cooling arrangement surrounds an optical axis of the laser spark plug.

8. The laser spark plug of claim 1, further comprising: a heat-conducting arrangement which enables heat dissipation from an end area facing the combustion chamber in the direction of an end area facing away from the combustion chamber.

9. The laser spark plug of claim 8, wherein the cooling arrangement is in thermal contact with the heat-conducting arrangement.

10. The laser spark plug of claim 1, wherein the cooling arrangement includes a cooling body which has a material having a thermal conductivity of approximately at least 90 Watts per Kelvin and meter at room temperature.

11. The laser spark plug of claim 1, further comprising:

a heat-conducting arrangement which enables heat dissipation from an end area facing the combustion chamber of the laser spark plug in the direction of an end area facing away from the combustion chamber; wherein the heat-conducting arrangement is at least one of situated in an inner chamber of the laser spark plug and directly installed into at least one wall section of a housing of the laser spark plug.

12. The laser spark plug of claim 1, wherein the cooling arrangement includes at least one cooling body that concentrically surrounds an optical axis of the laser spark plug.

13. A method for operating a laser spark plug for an internal combustion engine of a motor vehicle, the method comprising: cooling at least one of a volume region present in an area of a combustion chamber window situated in an end area facing a combustion chamber and a medium present in the volume region to a temperature of between 300° C. and 350° C.

14. The method of claim 13, wherein a cooling arrangement for cooling is situated in the end area facing the combustion chamber.

* * * * *